United States Patent [19]

Herron

[11] 4,344,599

[45] Aug. 17, 1982

[54] ROCK DRILL BOOM STRUCTURE

[75] Inventor: Lorne R. Herron, Saltsjöbaden, Sweden

[73] Assignee: Atlas Copco Aktiebolag, Nacka, Sweden

[21] Appl. No.: 971,446

[22] Filed: Dec. 20, 1978

[30] Foreign Application Priority Data

Dec. 21, 1977 [ZA] South Africa ..... 777581

[51] Int. Cl.[3] ..... F16M 1/00

[52] U.S. Cl. ..... 248/660; 173/28; 248/654

[58] Field of Search ..... 248/654, 666, 647, 652, 248/653, 660; 173/38, 43, 42, 28, DIG. 3; 52/116; 175/315

[56] References Cited

U.S. PATENT DOCUMENTS

| | | | |
|---|---|---|---|
| 2,903,949 | 9/1959 | Simmonds | 173/28 X |
| 3,454,114 | 7/1969 | Poage | 173/28 |
| 3,490,546 | 1/1970 | Hattrup et al. | 173/28 X |
| 3,511,320 | 5/1970 | Miller | 52/116 X |
| 3,744,574 | 7/1973 | Carley | 173/28 X |
| 3,809,169 | 5/1974 | Hunt | 173/28 |
| 3,823,902 | 7/1974 | Bumueller | 173/28 X |
| 3,896,887 | 7/1975 | Council | 173/28 X |
| 3,965,628 | 6/1976 | Loftis | 52/116 X |
| 3,992,831 | 11/1976 | Bukovitz | 52/116 |
| 4,027,448 | 6/1977 | Tymciurak | 52/116 X |
| 4,108,254 | 8/1978 | Johansson | 173/43 |

FOREIGN PATENT DOCUMENTS

| | | | |
|---|---|---|---|
| 727844 | 2/1966 | Canada | 52/116 |

*Primary Examiner*—J. Franklin Foss

*Attorney, Agent, or Firm*—Frishauf, Holtz, Goodman & Woodward

[57] ABSTRACT

A rock drill boom structure comprises a support means, an elongated boom swingably carried by the support means and a feed beam on which a rock drill is mountable so as to be power displaceable therealong, the feed beam being carried by one end of the boom. The support means includes an elongated hollow guide means of substantially less longitudinal length than the boom and in which the boom is slidably received to project through both ends of the guide means, the boom being arrestable in the guide means, a rotatable member on which the guide means is pivotably mounted for pivotable movement about an axis transverse to the axis of rotation of the rotatable member, first power means for pivoting the guide means and second power means for rotating the rotatable member. The rotatable member 19 is preferably disc-shaped and has an aperture therein through which the power lines of the rock drill are drawn.

21 Claims, 8 Drawing Figures

ROCK DRILL BOOM STRUCTURE

BACKGROUND OF THE INVENTION

This invention relates to a rock drill boom structure and more particularly to such a structure which provides a simple and inexpensive mounting and rotation device for the boom.

Prior art drilling rigs with a boom structure of the above mentioned kind are very cumbersome in transport because of the overhanging length and weight of the boom structure. This is true even when the actual boom itself is telescopically extensible as is common in the art.

A boom structure according to the invention can, when mounted on a mobile carrier, be retracted into a transport position on the carrier. In the transport position it adds a comparatively short length to the carrier, and its center of gravity can be comparatively close to its mounting. This ensures easier and faster transport of the rig. One particular advantage is that the rig can be designed to fit within a mine shaft conveyance, such as a cage, without being dismounted. As a consequence, the transport of the rig into and down the mine and between the levels in the mine can be considerably facilitated.

The invention also provides a simple and inexpensive mounting and rotation device for the boom. The mounting device also permits for a simple drawing of the power lines through the boom.

An embodiment of the invention will now be described by way of example with reference to the accompanying drawings.

DETAILED DESCRIPTION

Figure 1:
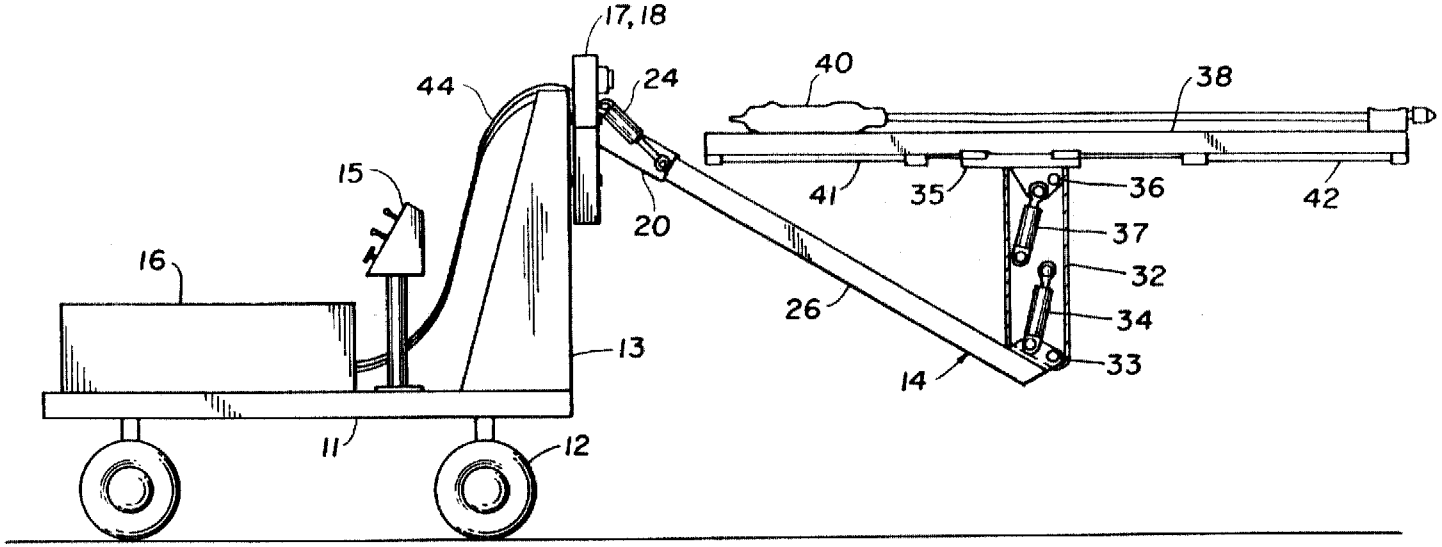
FIG. 1 is a side view of a rock drilling rig that is equipped with a drill boom structure according to the invention.
Figure 2:
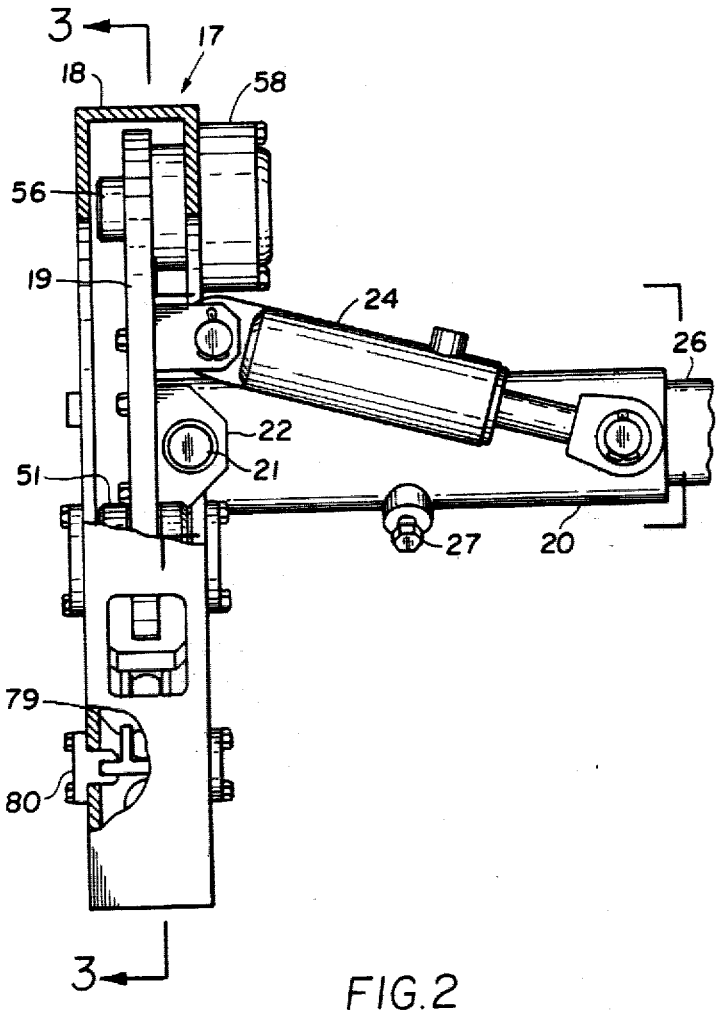
FIG. 2 is an enlarged side view of the mounting of the drill boom structure shown in FIG. 1.

The rock drilling rig shown in FIG. 1 comprises a chassis 11 on wheels 12. It has an upstanding bracket 13 on which a rock drill boom structure 14, an operator's control panel 15, and a power pack 16 are mounted. The boom structure comprises a support or mounting 17 that comprises a housing 18. The housing 18 is bolted to the bracket 13 and it carries within it a rotatable disc 19 in a way to be described later. A square section guide bushing 20 has a pair of trunnions 21 (FIG. 2) by which it is pivotably mounted to two lugs 22 on the disc 19. Two double acting hydraulic cylinders 23, 24 are pivotably coupled between the disc 19 and the guide bushing 20 to pivot the latter about the axis of the trunnions 21. The axis of the pair of trunnions 21 is parallel with the disc 19, i.e. it is perpendicular to the axis of rotation of the disc. A square section boom 26 is received within the guide bushing 20 and locked against axial movement by means of two locking bolts 27, 28. The disc 19 has a rectangular opening 29 so as to permit the boom to extend through the disc.

A hollow cross beam 32 of rectangular section is mounted on the outer end of the boom 26 to be pivotable on pivot 33 that is parallel with the pair of trunnions 21. In FIG. 1 the cross beam 32 is cut so that its interior is shown. Inside the cross beam 32 there is a hydraulic cylinder 34 that is coupled between the boom 26 and the cross beam 32 to tilt the latter about the pivot 33. A holder 35 is mounted on the outer end of the cross beam so as to be pivotable on a pivot 36 that is parallel with the pivot 33. The holder 35 is tiltable by means of a hydraulic cylinder 37 that is pivotably coupled between the holder 35 and the cross beam 32 and located inside the cross beam.

A feed beam 38 for a rock drill 40 is axially slidably mounted in the holder 35 and two long slender single acting hydraulic cylinders 41, 42 are mounted on the feed beam and they have their piston rods coupled to the holder 35 so that the feed beam can be axially displaced in the holder by means of these hydraulic cylinders. The feed beam 38 incorporates non-illustrated power means for axially displacing the rock drill along the feed beam, and the rock drill 40 can be a hydraulic or pneumatic percussion drill that rotates and hits a drill steel 43. The feed beam is not illustrated in detail. It can preferably be of the kind shown in U.S. patent application Ser. No. 904,214 and German Patent Publication DT OS 28 20 325.

The hydraulic hoses for the hydraulic cylinders 34, 37, 41, 42 for the non-illustrated feed motor of the feed beam and for the rock drill—if it is hydraulically operated—are conveniently drawn through the hollow boom 26. The hoses are only shown as a bundle of hoses 44 on the chassis.

Figure 3:
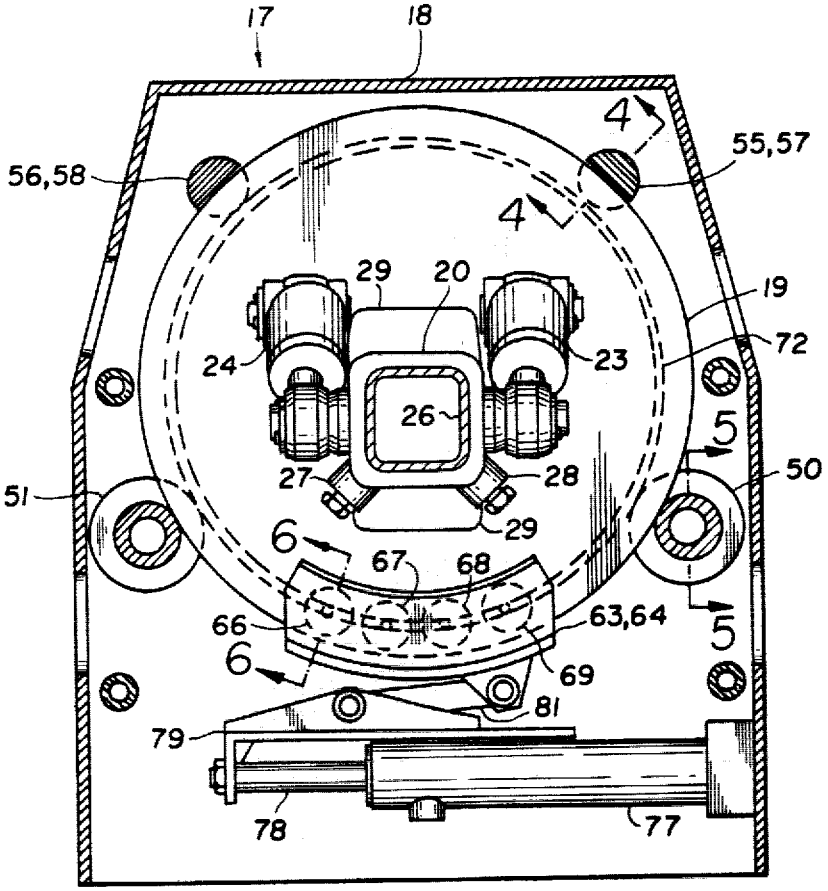
FIG. 3 is a view as indicated by arrows 3—3 in FIG. 2, the view being partly in section.
Figure 4:
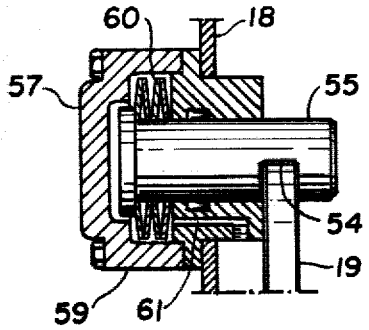
FIG. 4 is a section taken along line 4—4 in FIG. 3.
Figure 5:
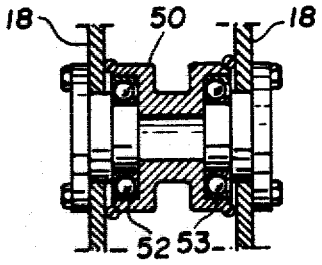
FIG. 5 is a section taken along line 5—5 in FIG. 3.
Figure 6:
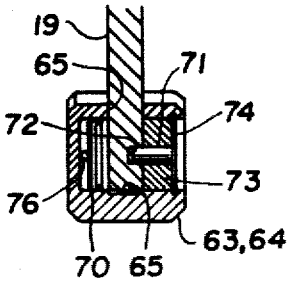
FIG. 6 is a section taken along line 6—6 in FIG. 3.
Figure 7:
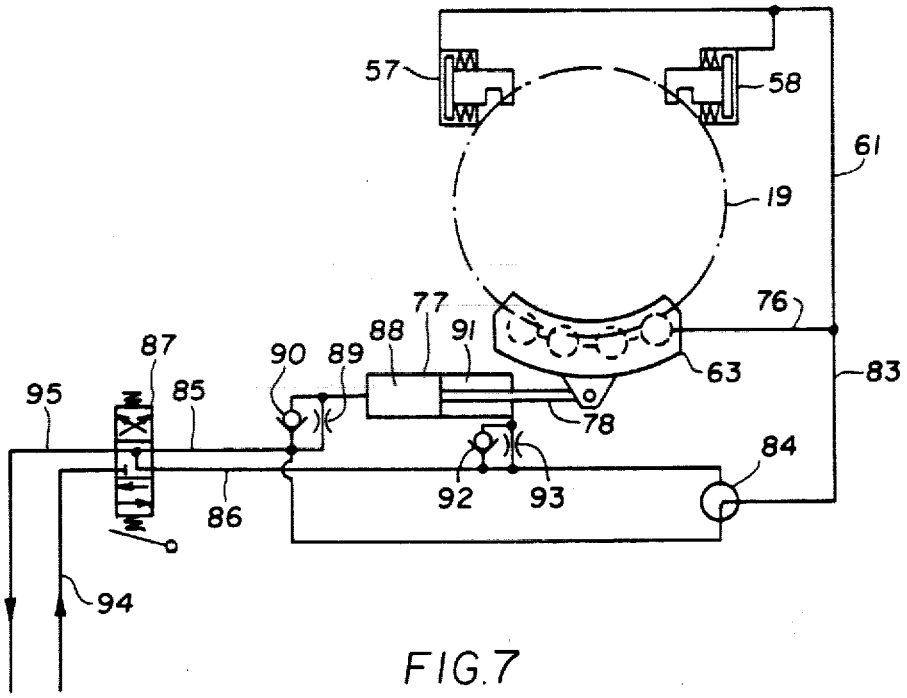
FIG. 7 is a diagram showing the hydraulic system for rotating a disc in the mounting shown in FIG. 2.

The housing 18 of the mounting 17 is bolted to the bracket 13. In FIG. 3 the housing 18 is partly cut away so that the interior of the housing can be seen. The housing 18 carries two waisted rollers 50, 51 that are journalled in roller bearings 52, 53 (FIG. 5). The rollers 50, 51 carry and guide the large diameter disc 19. The disc 19 is also guided by slots 54 in two bolts 55, 56. The bolts 55, 56 form part of two identical clamping units 57, 58. FIG. 4 shows the clamping unit 57 to which bolt 55 belongs. Each clamping unit 57, 58 comprises a housing 59 affixed to the housing 18. A stack of disc springs 60 is arranged to pull the bolt 55 inwardly so that the bolt clamps the disc 19 against the housing 59 of the clamping units. The housings 59 of the clamping units 57, 58 have passages 61 connected to a hose that is illustrated in FIG. 7 and has been given the same reference numeral 61.

When high pressure hydraulic fluid is supplied through the passages 61 to act upon the bolts 55, 56 counteracting the disc springs 60, the clamping units 57, 58 release their firm grip. The disc springs 60 should be stronger than the opposed hydraulic force so that they are not compressed. The bolts 55, 56 will now guide the disc 19 while permitting rotation thereof, although they still apply a braking force.

The lower end of the disc 19 is surrounded by a clamping unit 63 that comprises a U-formed arcuate member 64 that has four blind bores 66–69 extending through the slot 65 in the member. The bores 66–69 form cylinders for hydraulically actuated pistons 70. The clamping unit 63 is carried by the disc 19 by means of pins 71 that extend into a circular groove 72 in the disc 19. The pins 71 are carried by end plates 73 that are secured in the bores by snap-rings 74 in grooves in the bores. A passage 76 in the arcuate member 64 opens into the bottom of each blind bore and the passage 76 is connected to a hydraulic hose that has been given the same reference numeral 76 in FIG. 7. When the passage 76 is pressurized, the four pistons 70 clamp the clamping unit 63 to the disc 19. A double-acting hydraulic cylinder 77 is mounted in the housing 18 and its piston rod 78 is coupled to a reciprocable member 79 that is guided in guides 80 in the housing 18. The clamping unit 63 and the reciprocable member 79 are interconnected by means of a link 81 that is pivotably connected to both so that the cylinder 77 can be operated to move the arcuate member 65 along the guides 80.

The hydraulic cylinder 77, the clamping unit 63 and the two clamping units 57, 58 can be operated to rotate the disc 19 as will be described with reference to FIG. 7. The two clamping units 57, 58 and the clamping unit 63 are coupled to a common line 83. A selector valve 84 is operable to connect this line 83 selectively to one or the other of two lines 85, 86 that are controlled by a valve 87. The cylinder chamber 88 with the larger piston area is connected to the line 85 by means of a one-way valve 89 and a restriction 90 and the cylinder chamber 91 with the annular piston area is connected to the line 86 by means of a one-way valve 92 and a restriction 93. The control valve 87 is connected to pump and to tank on the power pack 16 by two lines 94 and 95 respectively. When the selector valve 84 is in its illustrated position the two clamping units 57, 58, the clamping unit 63, and the cylinder chamber 88 are connected in parallel to the line 85. When the selector valve 84 is in its other position the three clamping units 57, 58, 63 are instead connected in parallel with the cylinder chamber 91 to the line 86.

When the selector valve 84 is in its illustrated position, and the valve 87 is changed over to pressurize the line 85 and to drain the line 86, the clamping unit 63 grips at the same time as the two clamping units 57, 58 release their grip. The piston rod 78 moves to the right to move the clamping unit 63 to the right so that the disc 19 is turned counter-clock wise in FIG. 7. The restrictions 90, 93 delay the action of the cylinder so that the piston rod will not move before the clamping units have shifted their grips. Further, the restriction slows down the rotation of the disc 19.

When the valve 87 is instead changed over to pressurize the line 86 and drain the line 85, the two clamping units 57, 58 grip due to their springs and the clamping unit 63 releases its grip. The piston 78 moves to its withdrawn position to the left in FIG. 7 without turning the disc 19. When the control valve 87 is again changed over to pressurize the line 85 the disc 19 is again turned counter-clock wise. When the control valve 87 is in its illustrated normal middle position into which it is biased by springs, both lines 85, 86 are drained and the disc 19 is thus firmly arrested by the two clamping units 58, 59. It is appreciated that the disc is arrested also in the event of failure of the hydraulic system. When the selector valve 84 is in its non-illustrated position, operation of the valve 87 effects clockwise turning of the disc 19.

When drilling a tunnel face, the feed beam 38 is normally maintained in its illustrated position transverse to the cross beam 32. The parallelism of the feed beam is maintained by means of the cylinder 34 for tilting the cross beam 32 when the boom 26 is swung by the two cylinders 23, 24. When it is desired to drill holes transverse to the tunnel, i.e. roof bolt holes, the cylinder 37 is operated to tilt the feed beam into parallelity with the cross beam 32. The hydraulic system is such that the cylinder 34 can be operated to tilt the cross beam independently of the operation of the boom swinging cylinders 23, 24, and by switching a non-illustrated valve, one of the boom swing cylinders 23, 24 and the tilt cylinder 34 can instead be coupled in a masterslave relationship so as to make the feed beam move in parallelism when the boom is swung.

In the geometrical configuration shown the feed beam 38 does not move perfectly in parallelism. It will have a tendency to look out at the extreme swing positions of the boom. In order to provide for a perfect parallelism, the master and the slave cylinders should form similar triangels with the respective axes of swinging, and the master and slave cylinders should extend and shorten simultaneously to maintain the similarity in all positions. In the illustrated embodiment one of the cylinders extends when the other shortens and vice versa.

Figure 8:
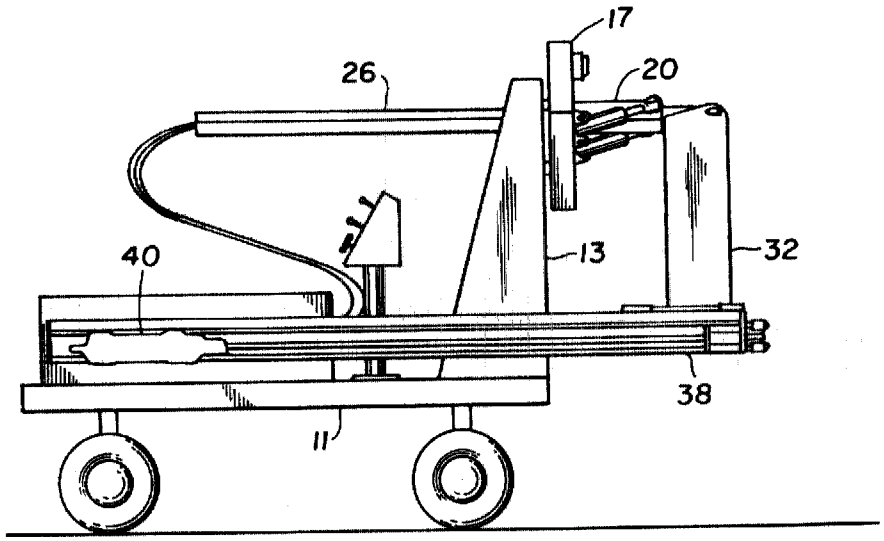
FIG. 8 shows the rock drilling rig shown in FIG. 1 in its transport position.

In FIG. 8, the rig is shown in its transport position. The boom 26 is horizontal and has been moved into its rearmost position in its guide bushing 20, the feed beam 38 has been moved to its rearmost position in its holder 35, and the rock drill 40 has been moved to its rearmost position on the feed beam 38. The disc 19 has been rotated to locate the feed beam 38 as close to the chassis as possible. In this position, the cross beam 32 will for example be inclined 45 degrees from the vertical. Because of the length of the cross beam 32, the feed beam and the boom can be parallel in the transport position. Another advantage with a long cross beam is that it makes the coverage area large although the boom 26 is comparatively short. The cross beam should preferably have a length that is at least one fourth of the length of the boom.

It may be advantageous to have the boom 26 in its fully withdrawn position or in a partly withdrawn position not only during transport but also during rock bolting when the feed beam 38 is parallel with the cross beam 32. For rock bolting purposes it may also be advantageous to make the cross beam in two parts; a base part in which the hydraulic cylinder 34 is located and an outer part in which the hydraulic cylinder 37 is located, the outer part being turnable relative to the base part about a longitudinal axis. Then the operator will be able to see the rock drill while standing at the panel 15 and drilling bolt holes.

The boom 26 is arranged to be manually displaced in its guide bushing 20. To facilitate the axial displacement, the operator may incline the boom to take advantage of its weight. Alternatively, power means can be provided to move the boom in its bushing. The boom can for instance be provided with a rack along its entire length and a motor with a pinion that engages with the rack can be mounted on the guide bushing. The possibility of displacing the feed beam 38 axially in its holder 35 is also used for thrusting the feed beam against the rock face before drilling of a hole starts.

The upper part of the bracket 13 has a U-form or any other suitable form that permits the boom 26 to extend backwardly past the bracket. If the chassis is railbound, the bracket 13 should preferably be turnable relative to the chassis about a vertical axis in order to facilitate driving a tunnel in a curve. The bracket 13 may additionally or alternatively be mounted on a transverse guide member on the chassis so that it can be laterally displaced relative to the chassis. If the chassis is carried by tyred wheels, the bracket need not be adjustably mounted on the chassis. Then, however, it will be advantageous to have power actuated support legs on the chassis in order to stabilize the rig during drilling.

What I claim is:

1. In a rock drill boom structure comprising support means (17), an elongated boom (26) swingably carried by said support means, a feed beam (38) on which a rock drill (40) is mountable to be power displaceable therealong, said feed beam being carried by one end of the boom, the improvement wherein said support means (17) includes:

an elongated hollow guide means (20) which is of substantially less longitudinal length than the boom (26) and in which the boom is slidably received to project through both ends of said guide means, the boom being arrestable in said guide means;

a rotatable member (19) on which said guide means (20) is pivotally mounted so that said guide means (20) is pivotable relative to said rotatable member about an axis transverse to the axis of rotation of said rotatable member;

first power means (23,24) coupled to said guide means (20) to pivot said guide means; and second power means (63,77) coupled to said rotatable member (19) to rotate said rotatable member.

2. A drill boom structure according to claim 1 wherein said rotatable member comprises a disc (19), and said support means (17) further comprises means (50, 51, 57, 58) to guide and support said disc at or near the periphery of said disc.

3. A drill boom structure according to claim 2 wherein said support means (17) further comprises selectively operable clamping means (57, 58) to engage with the disc (19) to hold the disc firmly to prevent rotation of the disc.

4. A drill boom structure according to claim 3 wherein said clamping means (57,58) comprises springs (60) for providing a spring type clamping action and fluid operated piston means (55, 56) to release the clamping action of the springs, said second power means (63, 77) for rotating said disc being fluid operated and connected in parallel with said clamping means (57, 58).

5. A drill boom structure according to claim 4 wherein said second power means to rotating said disc comprises fluid operated second clamping means (63, 70) arranged to engage with said disc (19) at or near the periphery of the disc when subject to fluid pressure, and a fluid operated power jack (77) operatively coupled to said second clamping means (63, 70) to move same to turn said disc (19).

6. A drill boom structure according to any one of the claims 1 or 2–5 further comprising a link (32) pivotably mounted on said one end of the boom (26), said feed beam (38) being mounted on said link and being transverse thereto.

7. A drill boom structure according to claim 6 wherein said link (32) is longer than one fourth of the length of the boom (26).

8. A drill boom structure comprising a base (17), a disc (19), support means (50, 51, 57, 58) on said base to engage with the peripheral part of the disc to carry, support and guide the disc, power means (63, 77) for selectively rotating the disc about the center axis of the disc, a boom (26) pivotably carried by said disc to pivot about an axis transverse to said center axis of the disc, and a feed beam (38) on which a rock drill (40) is mountable to be power displaceable therealong, said feed beam being carried by one end of the boom.

9. A drill boom structure according to claim 8 further comprising power means to selectively arrest the disc against rotation.

10. A drill boom structure according to claim 8 further comprising a link (32) pivotably mounted on said one end of the boom (26), said feed beam (38) being mounted on said link and being transverse to the link.

11. A drill boom structure according to claim 10 wherein said link (32) is longer than one fourth of the length of the boom.

12. A drill boom structure comprising a disc (19), mounting means (17) within which the disc is freely rotatable, clamping means (57, 58) for clamping the disc relative to said mounting means to prevent relative movement between the said disc and said mounting means, engagement means (63) adapted to engage said disc and to be secured thereto against relative movement, power means (77) for causing movement of said engagement means, means (61) for releasing said clamping means when said engagement means is moved and for re-energizing said clamping means on completion of movement of said engagement means.

13. A drill boom structure according to claim 1 wherein said boom (26) and said guide means (20) form together a kelly joint in which said guide means is pivotable and mountable off-center.

14. A drill boom structure according to claim 1 or 13 wherein said guide means comprises a bushing (20).

15. A drill boom structure according to claim 8 wherein said support means comprises selectively operable clamping means (57, 58) which is engageable with said disc (19) to hold said disc firmly to prevent rotation of said disc.

16. A drill boom structure according to claim 15 wherein said clamping means (57, 58) comprises springs (60) for providing spring type clamping action and fluid operated piston means (55, 56) to release the clamping action of the springs, said power means (63, 77) for selectively rotating said disc being fluid operated and connected in parallel with said clamping means (57, 58).

17. A drill boom structure according to claim 16 wherein said power means for rotating said disc comprises fluid operated second clamping means (63, 70) arranged to engage with said disc (19) at or near the periphery of said disc when subject to fluid pressure, and a fluid operated power jack (77) operatively coupled to said second clamping means (63, 70) to move same to turn said disc (19).

18. A drill boom structure according to claim 8 wherein said feed beam (38) and rock drill (40) have power lines (44), and wherein said disc (19) has an aperture (29) therein through which said power lines (44) are drawn.

19. A drill boom structure according to claim 12 wherein said engagement means (63) is carried and guided by said discs (19).

20. A drill boom structure according to claim 19 wherein said disc comprises an annular groove therein, and said engagement means comprises at least one pin (71) which is slideable in said annular groove of said disc.

21. A drill boom structure according to claim 19 wherein said engagement means (63) comprises clamping means (70).

* * * * *